US006142223A

United States Patent [19]

Bodas et al.

[11] Patent Number: 6,142,223

[45] Date of Patent: Nov. 7, 2000

[54] AIR-COOLED CONDENSER

[75] Inventors: Janos Bodas; Gabor Csaba; Zoltan Szabo, all of Budapest, Hungary

[73] Assignee: Energiagazdalkodasi Reszvenytarsasag, Budapest, Hungary

[21] Appl. No.: 09/142,255

[22] PCT Filed: Jan. 26, 1998

[86] PCT No.: PCT/HU98/00008

§ 371 Date: Sep. 25, 1998

§ 102(e) Date: Sep. 25, 1998

[87] PCT Pub. No.: WO98/33028

PCT Pub. Date: Jul. 30, 1998

[30] Foreign Application Priority Data

Jan. 27, 1997 [HU] Hungary ..... 97 00240

[51] Int. Cl.[7] ..... F28B 3/00; F28F 1/14

[52] U.S. Cl. ..... 165/183; 165/111

[58] Field of Search ..... 165/111, 183

[56] References Cited

U.S. PATENT DOCUMENTS

| | | | |
|---|---|---|---|
| 3,229,722 | 1/1966 | Kritzer | 165/183 |
| 3,556,204 | 1/1971 | Dehne | 165/111 |
| 3,710,854 | 1/1973 | Staub | 165/111 |
| 4,815,296 | 3/1989 | Amir | 165/111 |
| 4,909,309 | 3/1990 | Palfalvi et al. | 165/111 |
| 5,323,851 | 6/1994 | Abraham | 165/183 |

FOREIGN PATENT DOCUMENTS

| | | |
|---|---|---|
| 0 617 250 | 9/1994 | United Kingdom . |

*Primary Examiner*—Ira S. Lazarus
*Assistant Examiner*—Tho Duong
*Attorney, Agent, or Firm*—Dickinson Wright PLLC

[57] ABSTRACT

An air-cooled condenser comprising a distributing chamber for distributing a vaporous medium to be condensed, a condensate collecting chamber and finned tubes with fins on air side, said finned tubes being connected in parallel between the distributing chamber and the condensate collecting chamber, where each of the finned tubes comprises two parallel essentially flat side walls and exterior closings connecting the side walls, in the finned tubes there are longitudinal separation walls connected to the side walls and dividing the inner space of the finned tubes into longitudinal parallel channels, and in the separation walls there are breakthroughs and closure elements for allowing the flow of the medium between neighboring channels.

16 Claims, 7 Drawing Sheets

Prior Art

Prior Art

2

AIR-COOLED CONDENSER

TECHNICAL FIELD

The invention relates to an air-cooled condenser for condensing a vaporous medium, preferably steam.

BACKGROUND ART

Condensers are widely used in the manufacturing, chemical and energy industry. The air-cooled condenser is a special type of condenser, which generally operates under a vacuum. First of all we shall describe the physical processes that take place in air-cooled condensers, to make sure that the operation of the air-cooled condenser according to the invention is understood.

The description of physical processes and of the prior art apply to power plant steam condensers and to condensing steam, but of course the invention is not restricted to this type of condenser: they can also be used as applicable in other places and for other vaporous mediums where air-cooled condensers are required.

Air-cooled steam condensers generally consist of a large number of tubes connected in parallel which are densely finned on the air side. The processes taking place in the parallel tubes are principally identical, so it suffices to describe the processes taking place in a single tube.

FIG. 1 shows a schematical cross-sectional view of a known air-cooled condenser comprising a distributing chamber 14, a condensate collecting chamber 16 arranged on a lower level, and these sloping connecting parallel coupled condenser tubes 1 of which only one is shown.

The cross-section of the condenser tubes 1 can be different, and in practice generally condenser tubes 1 with round, elliptical or flat, horse-race track shaped cross-section are used. Inside the condenser tube 1, the condensing steam flows in the direction of arrow 2, and outside the condenser tube 1, perpendicular to the axis thereof, the cooling air flows in the direction of arrows 3.

Since the steam condensing in the condenser tube 1 has a very high heat transfer coefficient, which may be as high as 23.260 $W/m^2K$, and the air side heat transfer coefficient is low, between 58 and 81 $W/m^2K$, it is advisable to increase the air-side surface in order to improve the efficiency of heat exchange, which is practically implemented by fins 4.

From the direction of arrow 2, not only pure steam enters the condenser tube 1, but also a very low quantity of non-condensable gases, mainly air. One part of the non-condensable gases, as volatile alkalizers and dissociation products, are carried by the steam, while the larger part gets into the steam as a result of leaks in the technological system. In the case of an appropriately implemented and maintained steam turbine, the amount of non-condensable gases—mainly air—entering the condenser with the steam is 0.005 to 0.01% by weight.

Although this quantity in relation to the steam is very low, it becomes obvious later on that the operation of the condenser is very much influenced by the presence of non-condensable gases.

The condensate of the steam and the non-condensable gases must be removed continuously. A pipe 6 and a condensate pump 10 serves to discharge condensate 5 from the condensate collecting chamber 16, while mixture 7 of the non-condensable gases and some remaining steam leaves through an air extraction pipe 8 towards a vacuum pump 9.

In the course of condensation, the change in important physical characteristics, i.e. in the partial pressure of the air, in the steam space under-cooling, and in the steam-side heat transfer coefficient can be neglected as long as 97 to 99% of the steam is not condensed. The only exceptions from this rule are the flow volume and velocity of the steam-air mixture 7, which are inversely proportional with the volume of the condensed steam. Thus for example if 97% of the steam is condensed, the flow volume and the velocity are only 3% of the values at the entry point.

However, in the condensation of the remaining 3%, but especially in that of the last 0.5% of steam, due to the presence of non-condensable gases, significant changes can be experienced in the various parameters, as can be seen in the following table.

| | | | | |
|---|---|---|---|---|
| Remaining steam volume | 3% | 0.6% | 0.06% | 0.01% |
| partial pressure of air/non-condensable gases | 24 Pa | 120 Pa | 1200 Pa | 5000 Pa |
| under-cooling of the condensation space | 0.04° C. | 0.2° C. | 2° C. | 10° C. |
| decrease of steam-side heat transfer coefficient | 10% | 43% | 82% | 82% |
| volume of flowing steam-air mixture | 3% | 0.625% | 0.065% | 0.015% |

It can be seen that in the condensation of the remaining 3% of the steam the partial pressure of the air increases dramatically, and as a result, condensation temperature drops, or in other words, the under-cooling of the condensation space increases. Due to the increase in the air concentration, at the end of the condensation, the steam-side heat transfer coefficient decreases substantially. The volume of flowing steam-air drops to a fraction of the entry value.

Due to the changes listed above, it is a usual practice to separate the condenser, as shown in FIG. 2, to a main condenser 11 in which 80 to 90% of the steam is condensed and to an after-cooler 15 (dephlegmator), in which a part of the remaining steam is condensed and mixture 7 is under-cooled. The main condenser 11 and the after-cooler 15 are connected by the condensate collecting chamber 16, which on the one hand guides the steam exiting from the main condenser 11 to the after-cooler 15, and on the other collects the condensate 5, draining it through the pipe 6 to the condense pump 10.

The structure of the main condenser 11 corresponds to the condenser tube 1 in FIG. 1, i.e. the steam and the condensate 5 flow downwards in the same direction, but in the after-cooler 15, the mixture 7 flows upwards, and the condensate 5 downwards, in counterflow to the mixture 7. This is necessary because—as shown above—at the end of the condensation process the under-cooling of the mixture 7 dramatically increases, and in the case of ambient temperatures below the freezing point, the under-cooling could be of such a rate that the temperature of the condensation space also drops to below the freezing point, and as a result the condensate 5 could freeze up. The frozen condensate 5 could block the path of air extraction, causing the drop-out of the relevant condenser tube from the condensation process, and in the worst case, the frozen condensate 5 could even crack the tube.

The arrangement according to FIG. 1 also entails the disadvantages that due to the under-cooling of the steam space the temperature of the condensate 5 is lower than the theoretical condensation temperature, and when this condensate 5 is returned to the steam turbine cycle, it deteriorates the thermal efficiency of the system. A further undesirable effect is that due to the higher partial pressure of air and as a result of the under-cooling of the condensate 5, the latter absorbs a higher than permissible volume of oxygen, which could cause corrosion and require degassing prior to returning to the cycle.

The counterflow after-cooler 15 intends to reduce or eliminate these disadvantages, by making sure that the steam flowing in the opposite direction heats up the condensate 5.

The processes described so far arise when in the main condenser 11 and in the after-cooler 15 the steam-air mixture 7 flows towards the air extraction pipe 8 of the after-cooler 15. In the main condenser 11 this precondition is practically satisfied. If the condenser is dimensioned in a way that the steam velocity is 50 to 80 m/s at the entrance point, then assuming 95% condensation, at the exit of the main condenser 11 the steam velocity will be 2.5 to 4 m/s, which is just enough to make sure that the steam-air mixture 7 definitely flows in the direction of the exit.

In the after-cooler 15, however, this is not the case. Assuming that in the after-cooler 15 for the condensation of a remaining 5% steam, 10% of the tubes fitted into the main condenser 11 are installed, i.e. the flow cross-section drops to 1/10, the velocity at the entrance of the after-cooler 15 will be 25 to 40 m/s, but at the air extraction pipe 8 it will only be 0.16 to 0.25 m/s. To make sure that an excessive quantity of steam does not escape with the extracted air, and so that the application of a vacuum pump with an excessively large capacity is avoided, the after-cooler 15 is generally dimensioned in a way that at the air extraction pipe 8 the volume of the steam-air mixture 7 is only 0.03 to 0.04% of the entry volume, and that the air content of the extracted mixture 7 is 25 to 30% which occurs when the under-cooling of the steam-air mixture 7 is 4° to 5° C.

It is shown that the correct arrangement and dimensioning of the after-cooler 15 is an extremely difficult task. If for example a steam of low air content enters the after-cooler 15 at a high velocity, it reaches the air extraction pipe 8 as a result of the vortex flow and dilutes the mixture 7 to be extracted. The vacuum pump dimensioned for delivering a constant volume of air is then unable to remove all the air coming to the condenser, and so it accumulates first in the after-cooler 15 and then later in the main condenser 11 as well. The increasing air concentration dramatically increases the under-cooling of the steam space, and deteriorates the heat transfer coefficient, which entails a reduction in the heat dissipation of the condenser and may also cause a frost risk in cold weather. Since at the air extraction pipe 8 only extremely low volumes are flowing, fresh steam coming to this point even in a small volume could lead to the detrimental effects above.

Consequently, in the case of a correctly designed after-cooler, there should be no drastic drop of velocity between the inlet and extract points.

A correctly designed main condenser and after-cooler must also meet another requirement, namely that in the direction of the cooling air flow there should be only one row of finned tubes.

This is important because in the case of several tube rows, the tube row on the entry side of the cooling air receives much more cooling than the other tube rows, and so it has steam flowing in at both ends. The top end is the normal steam entry point, and the bottom end takes steam from the tubes of other rows via the common condensate collecting chamber.

As a result of this phenomenon, from the first, and eventually from the next tube row(s) the non-condensable gases are unable to escape, and stagnating air plugs develop. The length of these air plugs decreases gradually from the first tube row towards the next tube rows exposed to increasingly higher cooling air temperatures. In the stagnating zone filled up with air, the heat dissipation decreases and in a cold weather, frost risk may prevail. In order to eliminate these detrimental effects, air-cooled condensers with a single tube row are used. To make sure that a sufficient steam side cross section is available, an appropriate number of air-side fins can be installed and the air-side flow resistance is as low as possible, in practice generally flat finned tubes with horse-race track shaped cross-section are used.

DISCLOSURE OF INVENTION

The purpose of the invention is to design an air-cooled condenser, which

- has a low flow resistance on both the air-side and the steam-side (using flat tubes of large cross section, so that they are able to withstand a load of external or internal pressure);
- can be properly fitted with fins on the air-side;
- has air-side fins which can be designed optimally regarding heat transfer and air-flow;
- has finned tubes in which no air plugs can develop, so the removal of air is securely carried out under all operating conditions;
- ensures that the freezing of the pipes can be safely avoided;
- is simple and cost efficient.

Thus, the invention is an air-cooled condenser comprising a distributing chamber for distributing a vaporous medium to be condensed, a condensate collecting chamber and finned tubes with fins on air side, said finned tubes being connected in parallel between the distributing chamber and the condensate collecting chamber. Each of the finned tubes comprises two parallel essentially flat side walls and exterior closings connecting the side walls, in the finned tubes there are longitudinal separation walls connected to the side walls and dividing the inner space of the finned tubes into longitudinal parallel channels, and in the separation walls there are breakthroughs for allowing the flow of the medium between neighbouring channels.

In a preferred embodiment of the invention at least some of the finned tubes is divided by closure elements formed in the channels and by breakthroughs formed in the separation walls adjacent the closure elements into a main condenser conducting the medium from the distributing chamber to the condensate collecting chamber and an after-cooler conducting the medium from the condensate collecting chamber towards the distributing chamber to an air extraction pipe.

This embodiment enables that all condenser tubes of the condenser can be of the same type, i.e. it is not necessary to design and manufacture a separate condenser and after-cooler, as well as a connecting tube. Thanks to this embodiment air plugs do not develop as a result of a change in the temperature of the cooling air or as a result of the lack of balance in steam distribution. The after-cooler is in metallic contact with the main condenser, from which in this way sufficient heat is transferred to the high air content sections around the air extraction pipe all the time, so that the sections may not freeze up.

Each of the closure elements is preferably disposed in a distance from the distributing chamber so that said distance successively increases starting from an exterior channel towards the interior of the finned tube, the breakthroughs adjacent the closure elements deflects the medium into a neighbouring channel, and the air extraction pipe is connected to a section of the exterior channel between its closure element and the condensate collecting chamber in the vicinity of said closure element.

The closure elements and the breakthroughs adjacent to them are arranged in the channels preferably in such a way that they prevent formation of air plugs within the channels. Starting from the exterior channel preferably about half of the channels are provided with said closure elements. In this way a continuously narrowing cross-section for the medium is ensured.

The closure elements and the breakthroughs adjacent to them are preferably formed to allow the condensed medium to get into the neighbouring channel by gravitation.

The condenser according to the invention preferably comprises further breakthroughs formed in separation walls between the channels of the main condenser and/or between that of the after-cooler.

In another preferred embodiment of the condenser each separation wall includes a number of breakthroughs, said breakthroughs are preferably formed equally spaced in the separation wall. Also in this way the developing of air plugs within the channels having a stronger cooling can be prevented as it is possible for the medium to flow through the breakthroughs in that channels where due to the faster condensation of the medium the pressure of the condensation space drops.

BRIEF DESCRIPTION OF DRAWINGS

The invention will hereinafter be described on the basis of preferred embodiments depicted by the drawings, where.

BEST MODES FOR CARRYING OUT THE INVENTION

Figure 1:
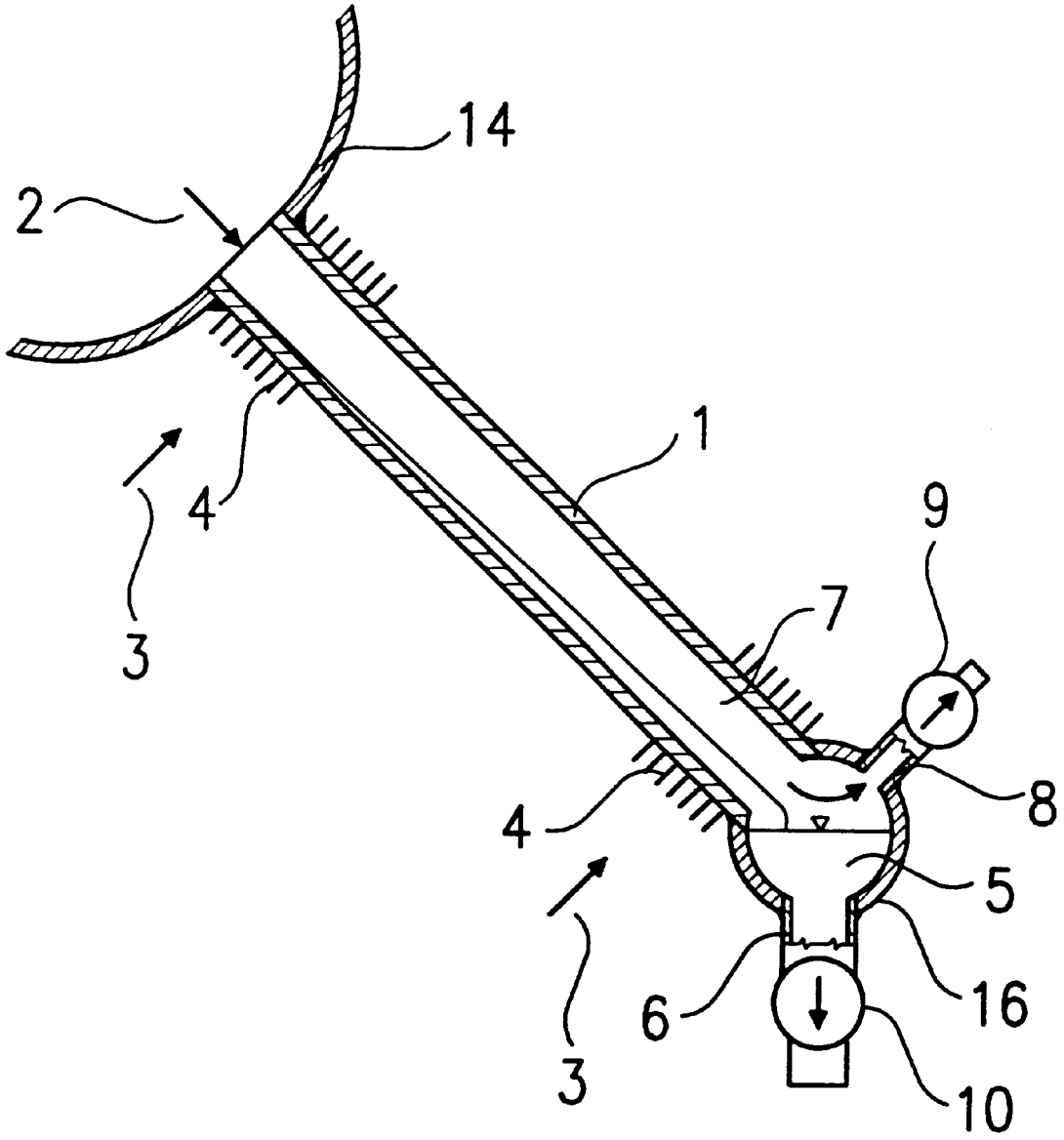
FIG. 1 is a schematic cross-section of a known air-cooled condenser.
Figure 2:
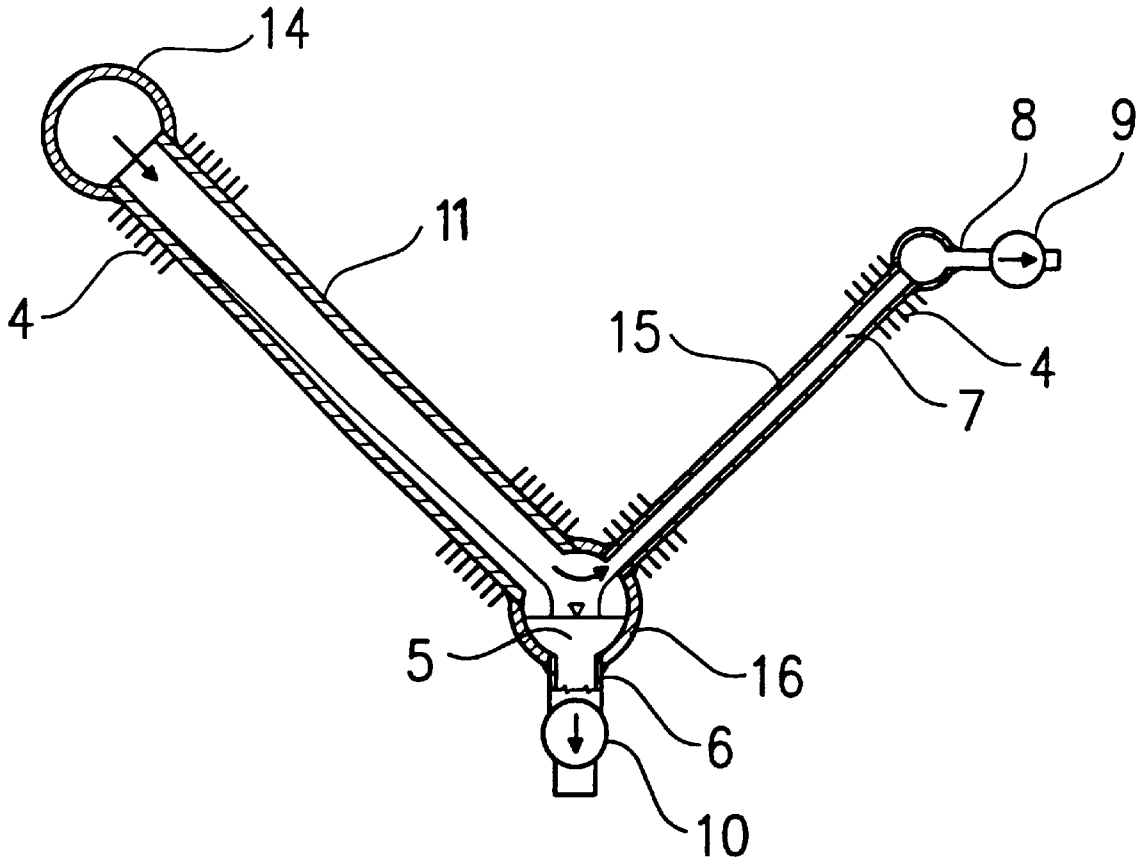
FIG. 2 is a schematic cross-section of a known air-cooled condenser consisting of a main condenser and an after-cooler.
Figure 3:
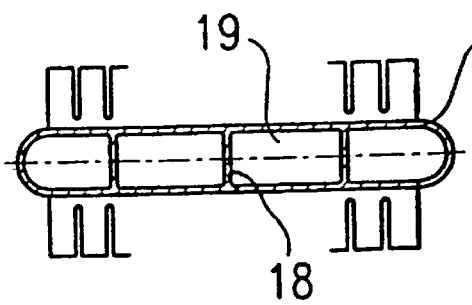
FIGS. 3 and 4 are lateral and longitudinal cross-sectional views, respectively, of a finned tube for the condenser according to the invention having a flat design fitted with internal separation walls.
Figure 4:
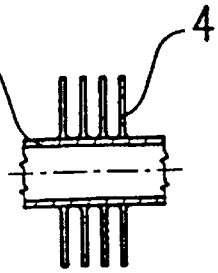

FIGS. 3 and 4 are lateral and longitudinal cross-sectional views, respectively, of a finned tube 17 according to the invention having a flat design with a pair of essentially flat side walls and arched exterior closings, i.e. it has a horse-race track shape. In the interior of the finned tube 17 there are separation walls 18 arranged, which separate internal longitudinal channels 19. Air-side fins 4 are located on the external flat sides of the finned tube 17. The fins 4 are fitted with slots perpendicular to the flow direction, so that a thick boundary layer detrimental to heat transfer may not develop around the finned tube 17.

Figure 5:
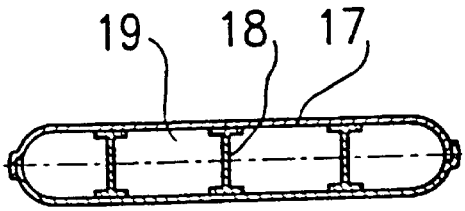
FIGS. 5–7 are cross-sectional views of various embodiments of flat finned tubes having internal separation walls.
Figure 6:
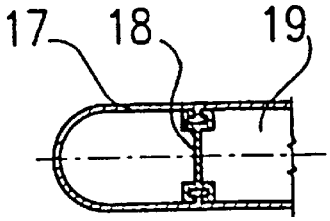
Figure 7:
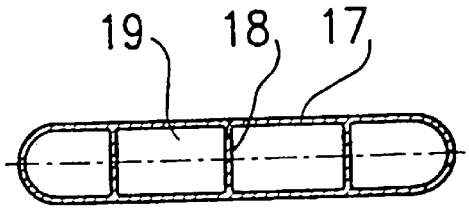

In FIGS. 5–7 some embodiments of the tube part of the finned tubes 17 are shown. In the embodiment according to FIG. 5, the tube part consists of two halves, and the separation walls 18 are also separate pieces. The separate pieces may be welded, soldered, attached with an adhesive or connected together via mechanical load transmitting fastening.

In the embodiment as per FIG. 6, the tube part consisting of two halves and the separation walls 18 can be inserted into each other and then the two halves can be joined by welding or soldering.

FIG. 7 depicts a tube part made by extrusion, where the tube part and the separation walls 18 are of one piece, so that the tube part can be produced by a single operation.

Figure 8:
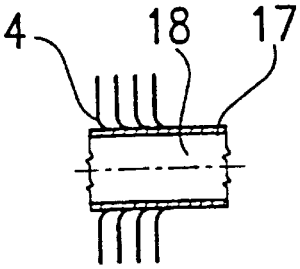
FIGS. 8–10 are cross sectional views showing various embodiments of the air-side fins.
Figure 9:
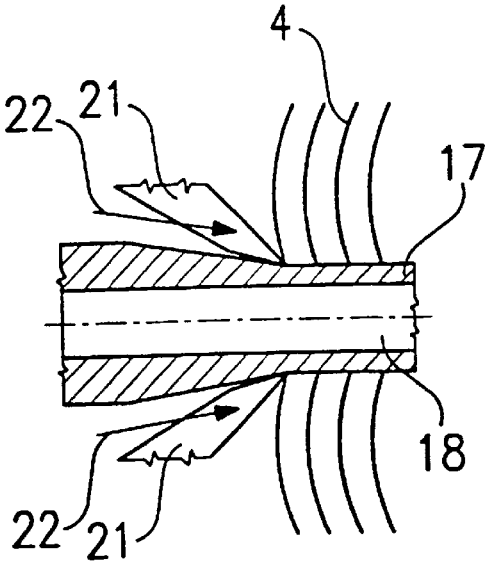
Figure 10:
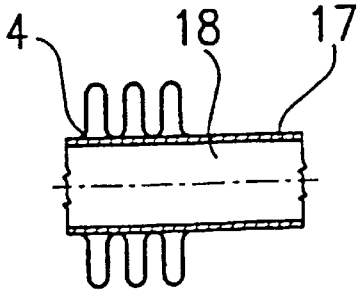

In FIGS. 8–10 some embodiments of the air-side fins 4 of the finned tubes 17 are shown. In FIG. 8, the roots of the fins 4 are flanged, and they are fixed on the tube 17 by soldering, by using an adhesive or without a binder by a tight fit.

In FIG. 9, the fins 4 can be shaped by cutting out of the tube material in a way that blades 21 move in the direction of arrows 22, and after shaping each pair of fins 4, they are shifted to the left by one fin spacing and then the next pair of fins 4 are produced.

FIG. 10 shows a fin 4 made of a corrugated sheet, which can be fixed for example by soldering to the tube 17.

In addition to their other function to be described later, the separation walls 18 have the advantage that they support the large flat side walls of the finned tube 17 against both external and internal pressure, and so it is not necessary for the fins 4 to contribute to the load bearing capacity of the side walls. Therefore, in designing the fins 4 and in the method of fixing them to the side wall, there is no restriction as far as strength of the finned tubes 17 is concerned, and they can be designed with optimal shape from the aspect of heat transfer. Such fins 4 are generally not suitable for taking the load exerted by internal or external pressure on the side wall, but they are excellent from the aspect of heat transfer.

Figure 11:
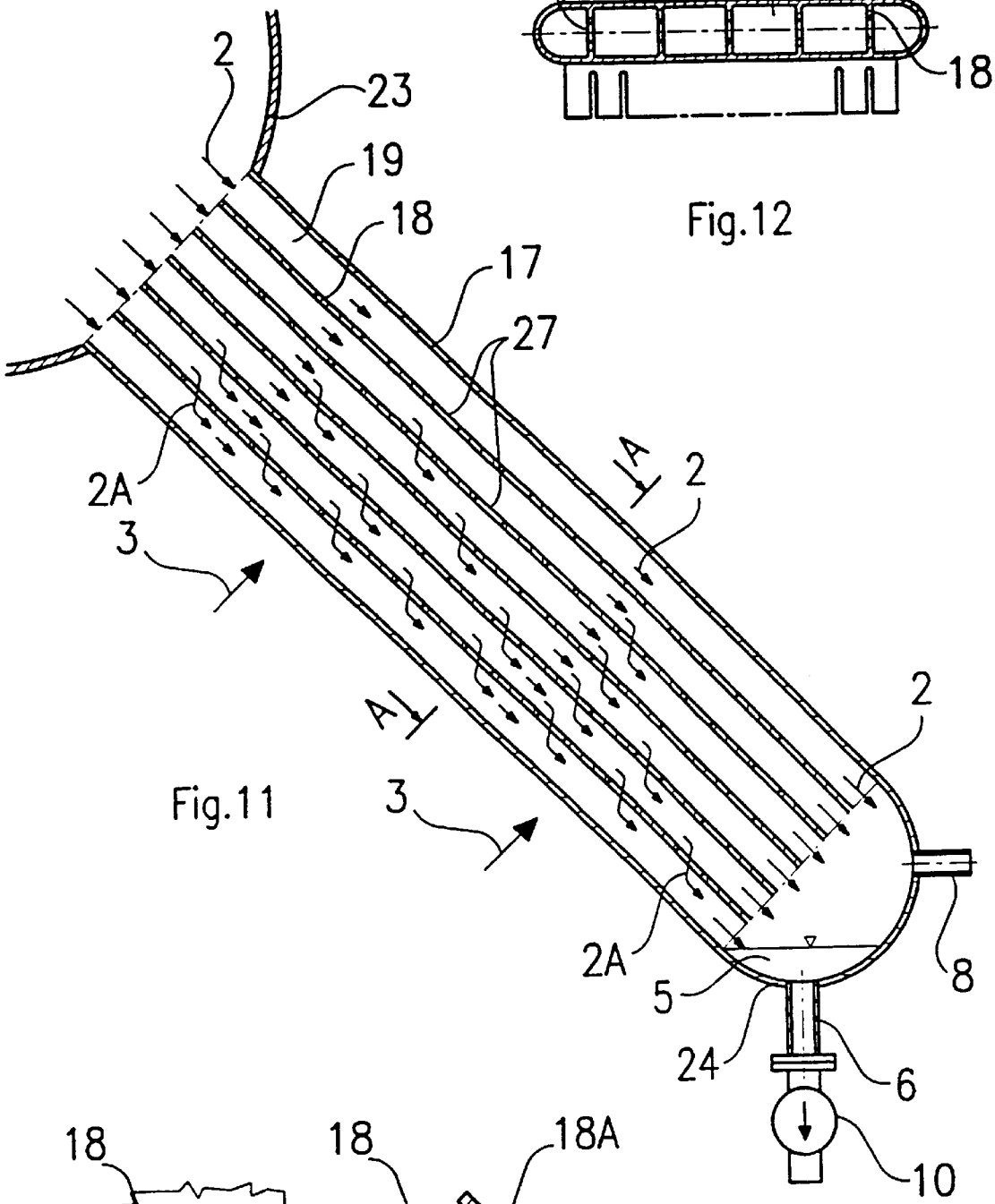
FIG. 11 is a longitudinal cross-sectional view of a preferred embodiment of a condenser tube according to the invention fitted with internal separation walls, internal channels and breakthroughs on the separation walls.

FIG. 11 shows an air-cooled condenser according to this invention comprising a distributing chamber 23, a condensate collecting chamber 24 arranged on a lower level, these sloping connecting parallel coupled finned tubes 17 described above with fins 4 on air side. In the cross sectional view only one finned tube 17 is shown. As the finned tubes are parallel coupled, it suffices to describe the structural design of one finned tube 17.

From the distributing chamber 23, which is a steam distributor pipe in this embodiment, steam containing a low volume of air is introduced in the finned tube 17. There are five separation walls 18 in the finned tube 17 dividing it into six internal longitudinal channels 19. The air-side fins 4 are located on the external flat side wall of the finned tubes 17.

In the channels 19, the steam and the condensate 5 flow downwards into the condensate collecting chamber 24.

Figure 12:
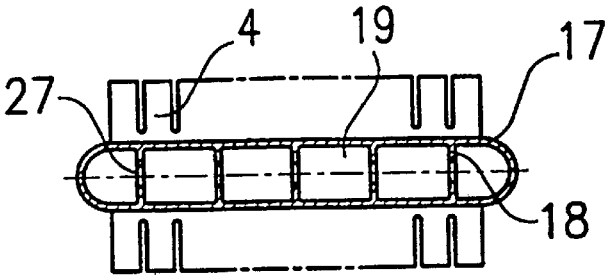
FIG. 12 is a cross sectional view of the preferred embodiment in FIG. 11 taken along plane A—A.

From here, the condensate 5 is discharged through a pipe 6 by a condensate pump 10. At a uniform spacing, breakthroughs 27 are located in the separation walls 18. They connect the channels 19 of the finned tube 17, and so the steam can flow from any channel 19 to any channel 19. When in this embodiment the air flowing in the direction of arrows 3 condenses the steam flowing in the channels 19 on the entry side faster than in channels 19 farther from the air entrance point, it is possible for the steam to flow also in the direction of arrows 2A through the breakthroughs 27, and so in the channels 19 on the entrance side, the developing of air plugs can be prevented. FIG. 12 shows a lateral cross sectional view of the finned tube 17 in FIG. 11 taken along plane A—A.

Figure 13:
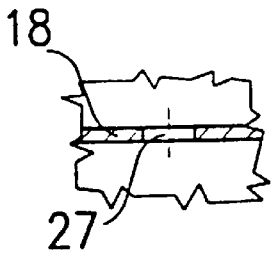
FIGS. 13 and 14 are cross-sectional views of two preferred embodiments of the breakthroughs in the separation walls.
Figure 14:
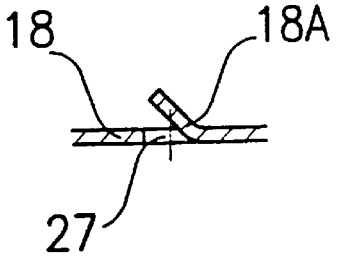

The breakthroughs 27 can be formed in different ways. FIGS. 13 and 14 show two types of breakthroughs 27 as an example. In FIG. 13 the breakthrough 27 on the separation wall 18 is a round or rectangular opening, and in FIG. 14 the breakthrough 27 is formed in a way that in the separation wall 18 three sides of an oblong section are cut through, and the oblong section is folded out at the fourth uncut side. The folded out part 18A facilitates the guiding of the steam, and in forming the breakthrough no waste is generated.

Figure 15:
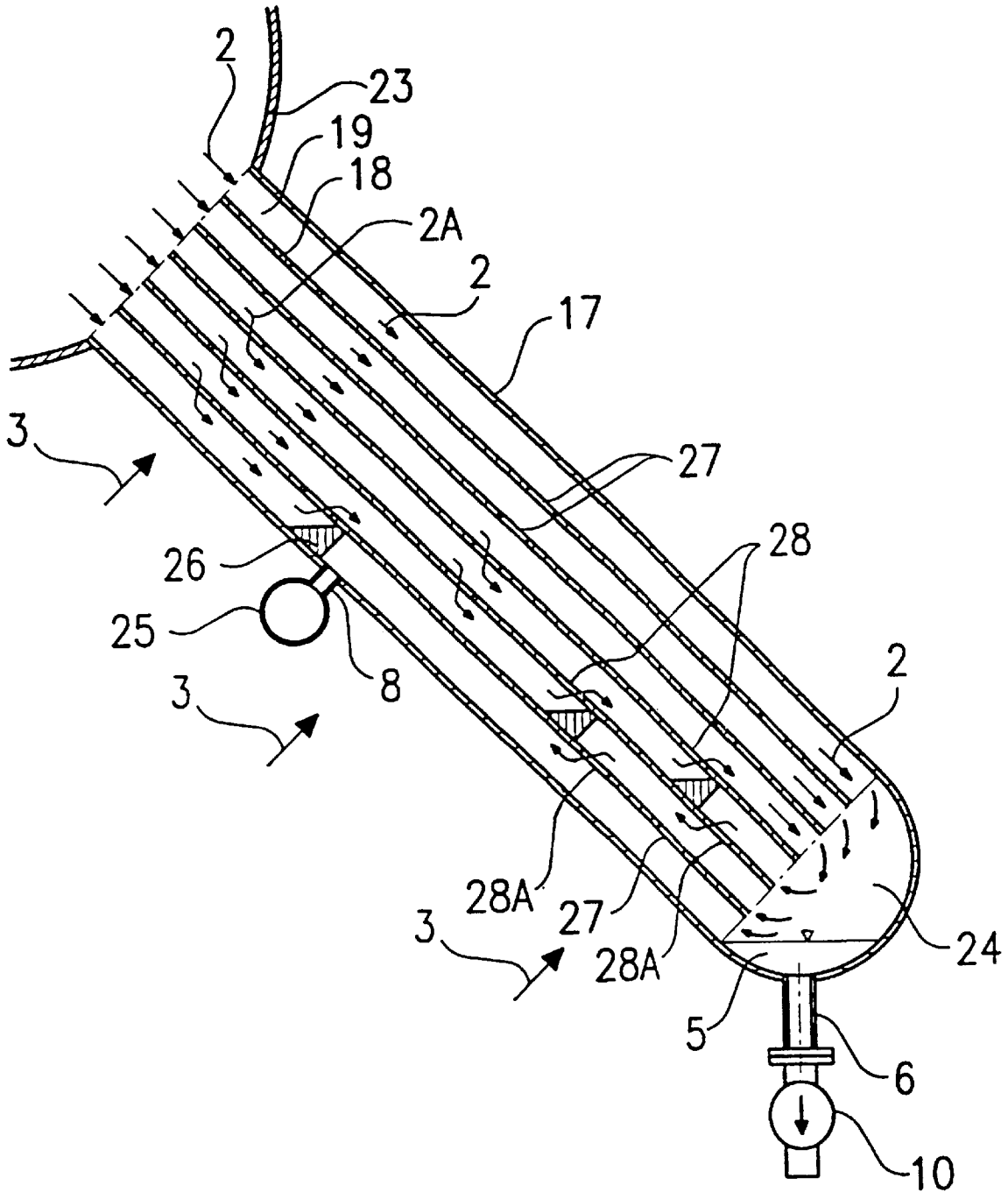
FIG. 15 is a longitudinal cross-sectional view of another preferred embodiment of a condenser tube according to the invention divided into a main condenser and an after-cooler.

FIG. 15 depicts another preferred embodiment of the condenser according to the invention. In this embodiment the finned tube 17 is divided into a main condenser 11 and an after-cooler 15 by closure elements 26 arranged in the channels 19. The closure elements 26 are placed in the first, second and third channels 19. The closure elements 26 are fitted in a way that from the end of the first channel 19 the longest, from the second one a shorter and from the third one the shortest section is separated. To make sure that the condensate can leave the channels 19 separated by the closure elements 26 and that the steam is able to flow throughout, breakthroughs 28 and 28A are formed immediately above and below the closure elements 26 on the adjacent separation walls 18. Therefore, for the steam flowing in the direction of arrows 2, a gradually decreasing cross section is available when flowing towards the condensate collecting camber 24, and from the condensate collecting camber 24 to an air extraction pipe 8 which ensures that a sufficient steam velocity is available at the air extraction pipe 8.

A number of breakthroughs 27 in the separation walls 18 between the channels 19 of the main cooler 11 and that of the after-cooler 15 are located again in the finned pipe 17 to connect said channels 19, and so no air plug is developed on the entry side of the air.

From the condensate collecting chamber 24, the steam-air mixture is introduced in the after-cooler 15. The after-cooler 15 is also of narrowing cross section. Again, the single tube row principle is ensured by breakthroughs 27 in the after-cooler 15. At the highest point of the after-cooler part of the exterior channel 19 is the air extraction pipe 8 located, to supply the remaining steam-air mixture through collecting tube 25 to the vacuum pump. In the after-cooler 15, the steam-air mixture flows upwards, and the condensate 5 flows downwards, i.e. in a counterflow.

Figure 16:
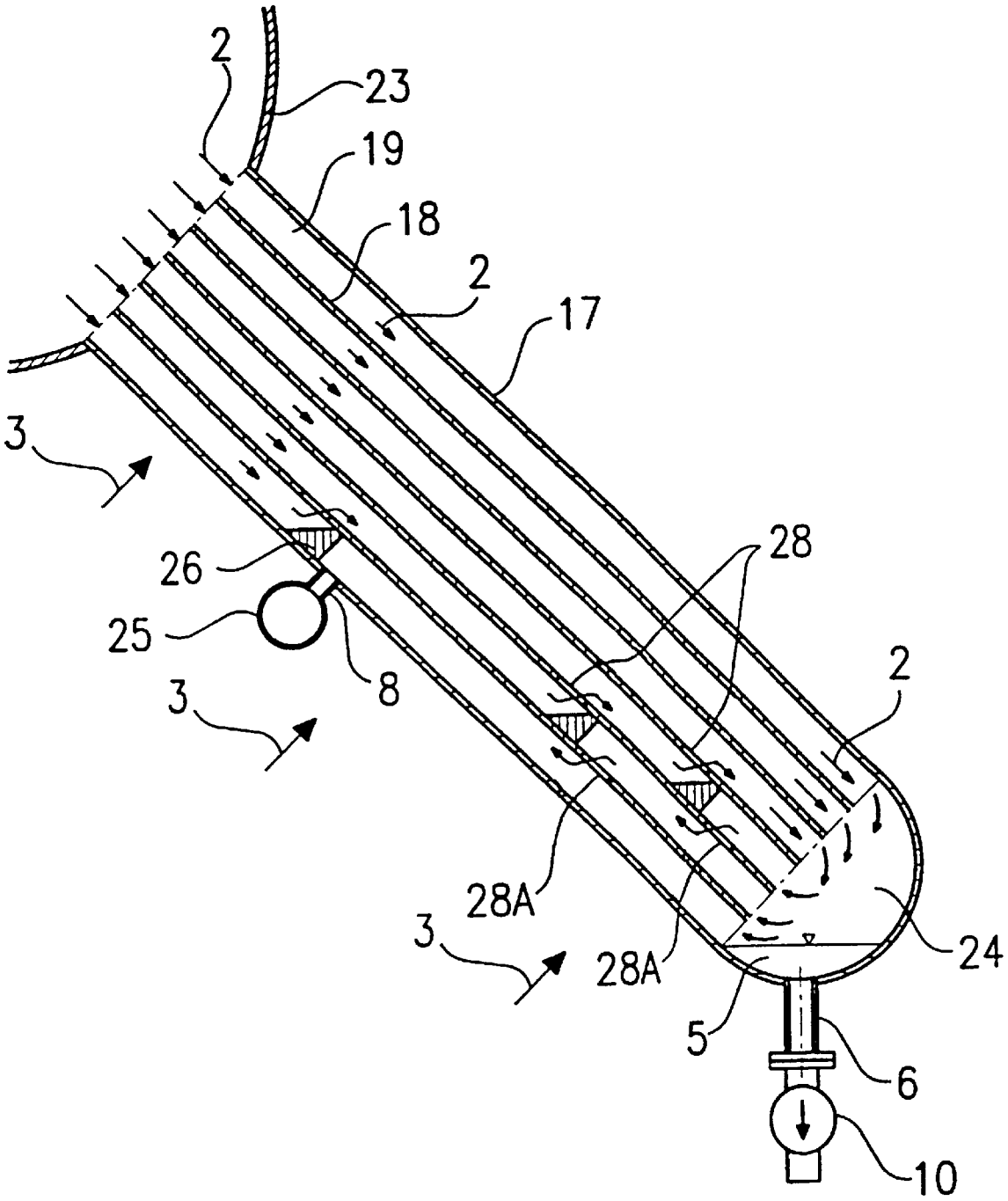
FIG. 16 is a longitudinal cross-sectional view of a further preferred embodiment of a condenser tube according to the invention.

In case the condenser is installed at a site where hot climate conditions prevail, and no frost risk is imminent, breakthroughs 27 may be omitted. This embodiment is shown in FIG. 16. In this embodiment it is advisable to locate the closure elements 26 in a way that they are at the upper boundary of the earlier mentioned gradually developing stagnating air plugs. Even in this case it is necessary to have breakthroughs 28 and 28A on the two sides of the closure elements 26.

The after-cooler 15 in the condenser according to the invention can also be arranged on the side opposite the air entrance point, consequently the cooling thereof is performed by air which has been heated up to a certain extent. This embodiment makes the freezing up of the after-cooler 15 avoidable in the case of cold climates. A similar preferred embodiment can be provided by making possible to change the direction of rotation of a fan driving the cooling air, so that the after-cooler 15 is transferred to the side opposite the entrance point of the cooling air. In this way, an equipment operating optimally under both hot and cold climate conditions is established.

Figure 17:
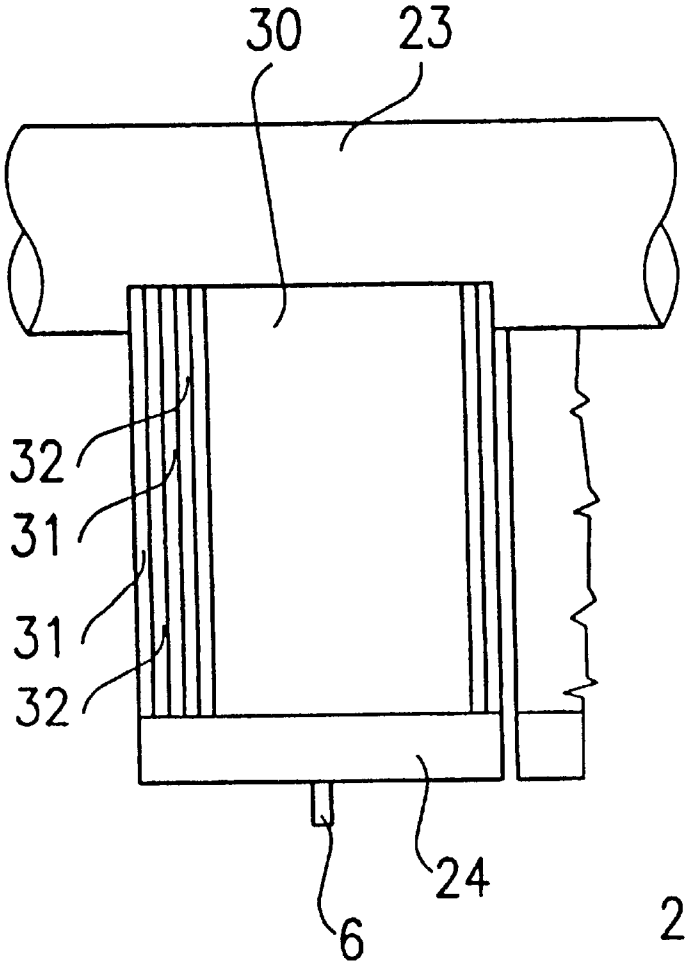
FIG. 17 is a schematical view of an air-cooled condenser according to the invention, in which finned tubes with and without after-cooler are installed alternatingly.

FIG. 17 is a schematical view of an air-cooled condenser 30 according to the invention, in which finned tubes 31 and 32 with and without after-cooler, respectively, are installed alternatingly. The finned tubes 31 and 32 can be arranged in a desired proportion, depending on the appropriate velocity in the after-coolers, on the heat transfer surface of the after-coolers, or on other parameters.

Figure 18:
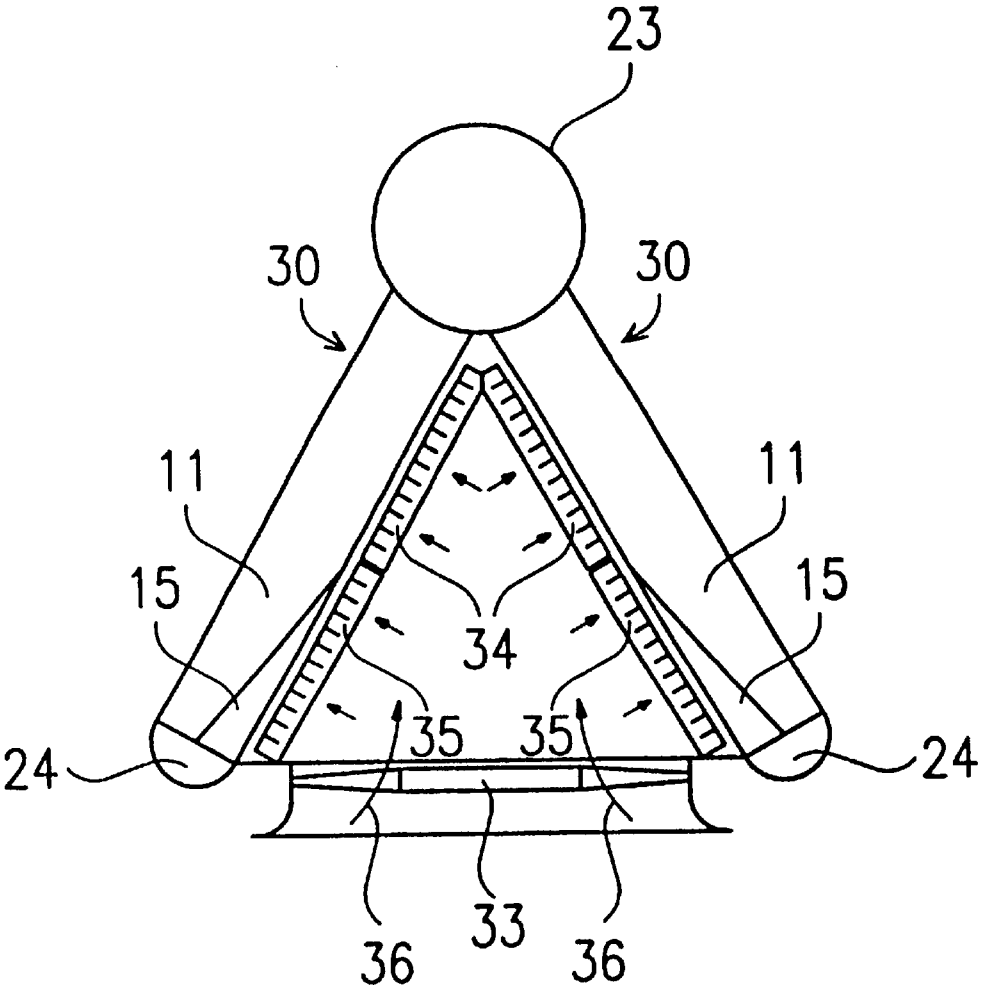
FIG. 18 is a schematical view of another preferred embodiment of the air-cooled condenser.

In certain cases, especially in the case of condensers operating under cold climate conditions, it may be necessary to accomplish a higher cooling effect in the section of the finned surface of the finned tubes where the after-cooler is located, than in the section exclusively of the main condenser. This requirement may be met by driving a higher air flow across the after-cooler section than across the main condenser section. Such an embodiment is shown in FIG. 18, where fan 33 drives the air to condensers 30 connected to a common steam distribution pipe 29. The air flows in the direction of arrows 36. At the entrance side of the air, louvres 34 and 35—which can be operated separately—are located. Louvre 34 covers the part including exclusively the main condenser 11, and louvre 35 covers the part including the after-cooler 15. By changing the positions of the two louvres 34 and 35, changing the quantity of air flowing across main condenser 11 and after-cooler 15 can be ensured independently from each other.

The advantages of the integrated main condenser/after-cooler described above are the following:

- All condenser tubes of the condenser can be of the same type, it is not necessary to design and manufacture a separate condenser and after-cooler and a connecting tube.
- The velocity and pressure of steam in the distributing chamber change. Accordingly, in the condenser tubes connected to the distributing chamber the steam is not uniformly distributed, which deteriorates the flow and heat characteristics of the condenser and could also entail a frost risk under critical conditions. In the solution according to the invention, where each finned tube has its own after-cooler and air extraction pipe, this lack of balance is much less than in the case of condensers of known designs.
- Thanks to the structural design where each finned tube has its own after-cooler and air extraction pipe, air plugs do not develop as a result of a change in the temperature of the cooling air or as a result of the lack of balance in steam distribution.
- The after-cooler is in metallic contact with the main condenser, from which in this way sufficient heat is transferred to the high air content sections around the air extraction pipe all the time, and so they may not freeze up.
- By appropriate design of the air extraction pipe—using a small choke—it can be achieved that the collecting pipe takes steam-air mixture of the same amount from each of the finned tubes fitted into the condenser, and so each finned tube operates with the same preferred cooling.

It will be evident to those skilled in the art that the above disclosure is exemplary only and that various other alternatives, adaptations and modifications may be made within the scope of the present invention as defined by the following claims.

What is claimed:

1. An air-cooled condenser comprising:

a distributing chamber for distributing a vaporous medium to be condensed, a condensate collecting chamber and finned tubes with fins on air side, said finned tubes being connected in parallel manner between said distributing chamber and said condensate collecting chamber; and wherein each of said finned tubes comprises two substantially parallel side walls and exterior closings connecting said side walls, wherein there are longitudinal separation walls connected to said side walls and dividing an inner space of said finned tubes into longitudinal channels, and wherein at least one of said separation walls has thereon one or more breakthroughs for allowing the flow of said medium between neighboring channels, and wherein at least one of said channels is divided by a closure element formed within said channel, wherein there is at least one breakthrough formed in a separation wall near said closure element, wherein said condenser is divided into a main condenser portion for conducting said medium from said distributing chamber to said condensate collecting chamber, and an after-cooler portion for conducting said medium from said condensate collecting chamber towards said distributing chamber to an air extraction pipe.

2. The condenser according to claim 1, wherein each of said closure elements is disposed a predetermined distance from said distributing chamber so that said distance successively increases starting from an exterior channel towards an interior channel, wherein said breakthroughs adjacent said closure elements deflect said medium into a neighboring channel, and wherein said air extraction pipe is connected to a section of said exterior channel between its closure element and said condensate collecting chamber in the vicinity of said closure element.

3. The condenser according to claim 2, wherein said closure elements and breakthroughs adjacent to them are arranged in said channels in order to prevent formation of air plugs within said channels.

4. The condenser according to claim 2, wherein starting from said exterior channel about half of said channels are provided with said closure elements.

5. The condenser according to claim 2, wherein said closure elements and breakthroughs adjacent to them are formed to allow the condensed medium to get into the neighbouring channel by gravitation.

6. The condenser according to claims 1, 2, 3, 4 or 5, wherein further breakthroughs are formed in said separation walls extending between said channels of said main condenser portion.

7. The condenser according to claims 1, 2, 3, 4 or 5, wherein further breakthroughs are formed in said separation walls extending between said channels of said after-cooler portion.

8. The condenser according to claims 1, 2, 3, 4 or 5, wherein said after-cooler portion is placed before said main condenser portion in the direction of an air flow cooling said finned tubes.

9. The condenser according to claims 1, 2, 3, 4 or 5, wherein said after-cooler portion is placed after said main condenser portion in the direction of an air flow cooling said finned tubes.

10. The condenser according to claims 1, 2, 3, 4, or 5, further comprising an apparatus for flowing a cooling air, said apparatus being suitable to reverse the flow direction of said cooling air.

11. The condenser according to claims 1, 2, 3, 4 or 5, further comprising an apparatus for flowing and/or controlling a cooling air, said apparatus being suitable to control the flow of said cooling air at the finned surface of said after-cooler portion, and at the finned surface of said main condenser portion independently of each other.

12. The condenser according to claim 1, wherein each of said separation walls includes a number of breakthroughs, said breakthroughs being formed substantially equally spaced apart along said separation walls.

13. The condenser according to claims 1, 2, 3, 4, 5 or 12, wherein said separation walls are arranged perpendicular to said side walls, and/or are made of one piece with said side walls, or are welded, soldered and attached with an adhesive or connected via mechanical load transmitting fastening to said side walls.

14. The condenser according to claims 1, 2, 3, 4, 5 or 12, wherein said breakthroughs are openings in said separation walls or are formed as folded out parts of said separation walls.

15. The condenser according to claims 1, 2, 3, 4, 5 or 12, wherein said exterior closings of said finned tubes are arched.

16. The condenser according to claims 1, 2, 3, 4 or 5, wherein a first part of said finned tubes is provided with after-cooler portions formed by said closure elements, and a second part of said finned tubes is formed without closure elements but with breakthroughs in said separation walls.

* * * * *